US010689889B2

(12) United States Patent
Gorenbacher

(10) Patent No.: US 10,689,889 B2
(45) Date of Patent: Jun. 23, 2020

(54) DOOR ARRANGEMENT

(71) Applicant: Simonswerk GmbH, Rheda-Wiedenbrueck (DE)

(72) Inventor: Sergei Gorenbacher, Rheda-Wiedenbrueck (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 23 days.

(21) Appl. No.: 15/866,692

(22) Filed: Jan. 10, 2018

(65) Prior Publication Data

US 2018/0195327 A1 Jul. 12, 2018

(30) Foreign Application Priority Data

Jan. 12, 2017 (DE) ..... 20 2017 100 143 U

(51) Int. Cl.

| | |
|---|---|
| ***E05C 19/16*** | (2006.01) |
| ***A47K 3/30*** | (2006.01) |
| ***E05B 65/00*** | (2006.01) |
| ***E06B 7/09*** | (2006.01) |
| ***E06B 7/21*** | (2006.01) |
| ***E06B 7/23*** | (2006.01) |
| ***E06B 7/232*** | (2006.01) |
| *E05B 63/00* | (2006.01) |
| *E06B 7/20* | (2006.01) |

(52) U.S. Cl.

CPC ..... *E05C 19/16* (2013.01); *A47K 3/30* (2013.01); *E05B 65/0025* (2013.01); *E06B 7/09* (2013.01); *E06B 7/21* (2013.01); *E06B 7/232* (2013.01); *E06B 7/2314* (2013.01); *E05B 63/0056* (2013.01); *E06B 2007/202* (2013.01)

(58) Field of Classification Search

CPC ..... E05C 19/16; E05C 19/166

See application file for complete search history.

(56) References Cited

U.S. PATENT DOCUMENTS

| | | | | |
|---|---|---|---|---|
| 2,557,568 A * | 6/1951 | Sanders | E06B 1/38 | 49/397 |
| 2,984,510 A * | 5/1961 | Hoffmann | E05C 19/16 | 292/142 |
| 4,840,411 A * | 6/1989 | Sowersby | E05C 19/168 | 292/144 |
| 6,722,715 B1 * | 4/2004 | Chiang | E05C 19/168 | 292/251.5 |

(Continued)

FOREIGN PATENT DOCUMENTS

| | | | | |
|---|---|---|---|---|
| DE | 10050111 C1 * | 8/2002 | ..... | E05C 19/166 |
| DE | 202 19 171 * | 4/2003 | | |

*Primary Examiner* — Gregory J Strimbu

(74) *Attorney, Agent, or Firm* — Collard & Roe, P.C.

(57) ABSTRACT

A door arrangement has a door frame, a door leaf, door hinges and a magnetic closure device, wherein the door hinges are fastened on a hinge side of the door leaf and join the door leaf swivelably with the door frame. The door frame has a step for stopping the door leaf in the closed position, the step having a stop arm overlapping the door leaf in the closed position and a lateral arm. The closure device is formed from a magnet arrangement on the door frame as well as a magnetic material on a rim of the door leaf. The magnet arrangement is disposed on the lateral arm in such a way that a gap remains between the magnet arrangement and the magnetic material disposed on the rim of the door leaf.

12 Claims, 5 Drawing Sheets

(56) References Cited

U.S. PATENT DOCUMENTS

| | | | | |
|---|---|---|---|---|
| 6,763,639 | B2 * | 7/2004 | Bennett | E06B 1/6092 160/92 |
| 7,567,159 | B2 * | 7/2009 | Macken | E05C 19/16 16/49 |
| 9,879,461 | B2 * | 1/2018 | Conway | E05F 5/02 |
| 2011/0080009 | A1 * | 4/2011 | Redgrave | E05C 19/16 292/251.5 |
| 2012/0043768 | A1 * | 2/2012 | Graham | E05B 17/0033 292/251.5 |
| 2016/0340947 | A1 * | 11/2016 | Mazzocco | E05C 19/166 |

* cited by examiner

DOOR ARRANGEMENT

CROSS-REFERENCE TO RELATED APPLICATIONS

This application claims priority under 35 USC 119 of German Patent Application No. DE 20 2017 100 143.1, filed on Jan. 12, 2017, the disclosure of which is herein incorporated by reference.

BACKGROUND OF THE INVENTION

The invention relates to a door arrangement with a door frame, a door leaf, door hinges and a magnetic closure device, wherein the door hinges are fastened on a hinge side of the door leaf and join the door leaf swivelably with the door frame. The door frame has, as a stop for the door leaf in the closed position, a step, which has a stop arm overlapping the door leaf in the closed position and a lateral arm extending outside the door leaf. The closure device on the door frame comprises a magnet arrangement as well as a portion of magnetic material on a rim of the door leaf.

Cabinet doors that are held in a closed position by magnetic forces are known from the realm of furniture, as are shower doors from the sanitary sector. The advantage is achieved that such a door is on the one hand held securely by the magnetic forces and on the other hand can easily be pushed open, without having to actuate a door latch or any other mechanical locking device.

In the known door arrangements, the closure device comprises one magnet and one portion of metallic material. The magnet as well as the portion of metallic material are then disposed such that a direct mechanical contact is established. Upon reaching the closed position, the magnet arrangement is stopped against the magnetic material, and so a metallic clicking sound is produced. Because of the direct contact, it is also not possible to exclude a damage during long-term use. Finally, in the known constructions, the combination with a door seal is not directly possible.

SUMMARY OF THE INVENTION

The present invention specifically addresses a door arrangement, which preferably forms a building interior door. Thus, all components of the door arrangement must be sufficiently stable to cover an area of at least 1 $m^2$ to permit the passage of a person, wherein the weight of the door leaf is usually at least 10 kg.

According to a preferred configuration of the invention, the door leaf is made of glass, wherein such a glass pane has a relatively small thickness in comparison with other building interior doors. In contrast to the situation of a door of wood or tubular chipboard, hardware parts such as the aforesaid hinges, locks or the like cannot be used in the thin glass door at its rim.

Precisely against this background, the need also exists to specify a closure device that is as simple as possible, while also permitting a highly esthetic visual appearance. Furthermore, the retaining forces of the closure device must also be sufficient to hold the door leaf in its closed position.

Against this background, the task underlying the present invention is to specify a door arrangement with a visually inconspicuous closure device, which nevertheless is characterized by good performance properties precisely in regard to building interior doors. In particular, the closure device is also intended to be as wear-free and maintenance-free as possible and also be usable in combination with a conventional door seal.

The door arrangement according to the invention comprises a door frame, a door leaf, door hinges and a magnetic closure device, wherein the door hinges are fastened on a hinge side of the door leaf and join the door leaf swivelably with the door frame. The door frame has, as a stop for the door leaf in the closed position, a step, which has a stop arm overlapping the door leaf in the closed position and a lateral arm extending outside the door leaf. The closure device on the door frame comprises a magnet arrangement as well as a portion of magnetic material on a rim of the door leaf.

The magnet arrangement is disposed on the lateral arm in such a way that a clear gap remains between the magnet arrangement and the portion of magnetic material disposed on the rim of the door leaf. In the closed position of the door leaf, the magnet arrangement as well as the portion of magnetic material are positioned directly oppositely, but without being directly in contact. By virtue of the small space of typically between 0.5 mm and 10 mm, retaining forces can then be generated that hold the door leaf sufficiently securely in the closed position.

In a view of the closed door leaf from outside the door leaf, the magnet arrangement is then disposed in the region of the outer periphery.

Usually the magnet arrangement is located on the side opposite the hinges, where the door lock is also disposed on conventional building interior doors. In principle, however, other arrangements are also possible within the scope of the invention. For example, the closure device may be disposed with the magnet arrangement in the lintel area of the door frame and with the portion of magnetic material on the upper rim of the door leaf.

If, according to a preferred configuration of the invention, the closure device is disposed on the side of the door leaf opposite the hinges, a single closure device may be provided, which is then located preferably at a middle height of the door leaf. In particular, the closure device is then located in a middle third of the door leaf. Alternatively, two or more closure devices may also be present, in order to increase the closure forces on the whole. In a configuration with two closure devices, a first closure device is located, for example, on the side opposite the hinges in a lower region of the door leaf, while a second closure device is located on the side opposite the hinges in an upper region of the door leaf.

According to a preferred configuration, the door leaf is made of glass, wherein a closure device that is as inconspicuous as possible and scarcely visible is of advantage precisely for such a glass door. In particular, it is also possible to dispense completely with a door lock having a latch.

On the door leaf itself, only the portion of magnetic material has to be attached, in which case it may be a simple sheet-metal strip or else a sheet-metal angle piece. Such a sheet-metal strip or sheet-metal angle piece can be adhesively bonded in particularly simple manner on the lateral rim of the door leaf on its side opposite the hinges, and is then hardly visible during use of the door arrangement.

In contrast, the magnet arrangement is provided on the door frame and disposed on the step, which forms the stop for the door leaf, on the lateral arm. Particularly preferably, the magnet arrangement is inserted in the door frame, on the lateral arm, and thus is disposed concealed in particularly advantageous manner.

As regards the usual alignment of a door arrangement, the door leaf in closed position is positioned in a plane that is defined by the vertical as well as by a first horizontal direction. The first horizontal direction then extends along the width of the door leaf. Starting from an orthogonal coordinate system, the thickness direction of the door leaf then corresponds to a second horizontal direction.

The step forming the stop includes the stop arm, which is oriented parallel to the door leaf in the closed position and accordingly extends along the vertical and the first horizontal direction. The lateral arm extends at right angles thereto, in vertical direction on the hinge side of the door leaf as well as on the side of the door leaf opposite the hinges, and also along the second horizontal direction, i.e. in thickness direction. In the lintel region, the lateral arm likewise extends along the second horizontal direction and above the door leaf along the first horizontal direction. Relative to the entire door frame, therefore, the lateral arm forms a notch running around the outer rim of the door leaf.

Usually the described step is present as a stop on the hinge side, on the side opposite the hinges and in the lintel region. In principle, however, configurations are also conceivable in which the stop does not extend in the described manner around the door leaf. However, the step is present at least on the side opposite the hinges or in the lintel region, in order that the magnetic closure device can be disposed there.

According to the invention, the door leaf does not have to be fitted with a mechanically actuated catch and a door latch. It is therefore sufficient if the door leaf, preferably made of glass, has on its side opposite the hinges only a handle opening, a handle eye or an otherwise configured fixed handle. Such a fixed handle preferably extends on both faces of the door leaf, so that this can be easily pulled shut or pushed open. In principle, however, the closed door leaf can be pushed in its open direction even without a fixed handle.

The fixed handle may be readily constructed as a knob or bow.

According to a preferred configuration of the invention, the magnet arrangement has a plurality of magnets, which preferably are disposed in a row. In the usual alignment of the door leaf, it is possible, for example, to dispose several magnets one above the other in a row along the vertical direction, so that sufficient magnetic forces can be provided even if the lateral arm has small depth along the second horizontal direction, i.e. in thickness direction. In this connection, it must be considered that, precisely for a concealed arrangement, a relatively extended magnet arrangement along the vertical direction should also be perceived as not or hardly unappealing.

In the at least one magnet of the magnet arrangement, the poles with their surface normals are expediently aligned, in the direction of the rim of the door leaf that is adjacent in closed position, with the magnetic material disposed thereon. Thus, if the magnet arrangement is disposed on the side opposite the hinges (which means the lock side in a traditional door), the normal of the pole of the magnet is then oriented along the first horizontal direction.

If, according to the configuration of several magnets in a row, depicted in the foregoing as preferred, these expediently have an alternating pole alignment. If, in such an arrangement, the magnetic material is then located in direct proximity to the magnet arrangement when the door leaf is in closed position, the field lines pass through this magnetic material from one magnet directly to the adjacent magnet with opposite polarity, whereby particularly strong retaining forces and small stray fields are obtained. Even with respect to an open door leaf, the advantage of a relatively small zone of influence of the magnetic field is obtained by an alternating alignment of the poles, so that magnetically sensitive articles of a user, for example credit and magnetic cards, are much less exposed to corruption.

If a plurality of magnets is provided within the scope of the invention, they may have a cylindrical shape, for example, especially a circular cylindrical shape, wherein the poles are then aligned along the axis of the cylinder. In connection with such a configuration, the advantage is achieved that inexpensive, commercial standard magnets may be used. Since, within the scope of the invention, the portion of magnetic material is not stopped against the magnet arrangement, i.e. the magnets, no wear occurs and neither does any danger of damage to the magnets.

According to a preferred improvement of the invention, it is provided that the magnet arrangement has a positioning mechanism, with which the space between the magnet or the magnets of the magnet arrangement and the portion of magnetic material is adjustable. Thus, if the at least one magnetic closure device is disposed on the side opposite the hinges, the magnet arrangement can be expediently positioned along the first horizontal direction. By such a positioning, the clear gap remaining between the portion of magnetic material and the magnet arrangement may be varied, whereby the retaining forces may also be adjusted precisely.

Within the scope of the invention, various configuration options are available for the specific configuration of the magnet arrangement. In order to permit the described positionability, the magnet arrangement may have, for example, a fastening plate fastened to the door frame and a carrier plate, which can be positioned relative to the fastening plate and which carries the at least one magnet.

In a configuration with a plurality of magnets, the carrier plate may also be made of a magnetic material and form a kind of yoke element, precisely also with a preferred alternating pole alignment, whereby the magnetic forces are further enhanced and stray fields are reduced.

The fastening plate fastened on the door frame is preferably made of a nonmagnetic material, especially nonmagnetic metal, in order to permit a movement of the magnet or magnets without jamming and in order to avoid a reduction of the magnetic retaining forces. In particular, the fastening plate may have openings, through which the magnets having a cylindrical shape are passed.

A positioning of the carrier plate carrying the magnets relative to the fastening plate is possible, for example, by two adjusting spindles as the positioning mechanism.

Since the magnet arrangement is disposed on the lateral arm on the outer periphery of the door leaf, the door leaf can be stopped in particularly advantageous manner against a door seal, which is disposed on the step of the door frame. In particular, the door seal may be held in a seal groove machined in the stop angle piece.

Obviously the door seal may conceal the magnet arrangement at least partly when a door leaf is open, whereby this is further hidden from view.

If the magnetic arrangement is aligned in suitable manner relative to such a door seal, a desired compression of the door seal may also be achieved in the closed condition of the door leaf. If the door leaf is closed with great force, this movement can be cushioned by the door seal, while the closure device is then able to prevent the door leaf from bouncing open.

Even if this is not necessary for many practical cases, positionability of the magnet arrangement along the second horizontal direction, i.e. along the thickness direction of the door leaf, may be considered in principle, in order that the contact pressure of the door leaf against the door seal can be varied.

The magnet arrangement as well as the associated portion of magnetic material usually extends over an approximately equal length, i.e. over an approximately equal height along the vertical direction in the usual arrangement on the side opposite the hinges.

The length of the magnet arrangement as well as of the portion of magnetic material may be, for example, between 5 and 20 cm.

Due to the magnetic closure device, no locking secure against opening is assured. Against this background, the door arrangement is preferably provided for building interior doors that are not intended to be locked with a key. Alternatively, however, a separate locking by a bolt, shackle or the like is possible.

BRIEF DESCRIPTION OF THE DRAWINGS

The invention will be explained below on the basis of drawings, which are merely exemplary, wherein.

DETAILED DESCRIPTION OF THE EMBODIMENTS

Figure 1:
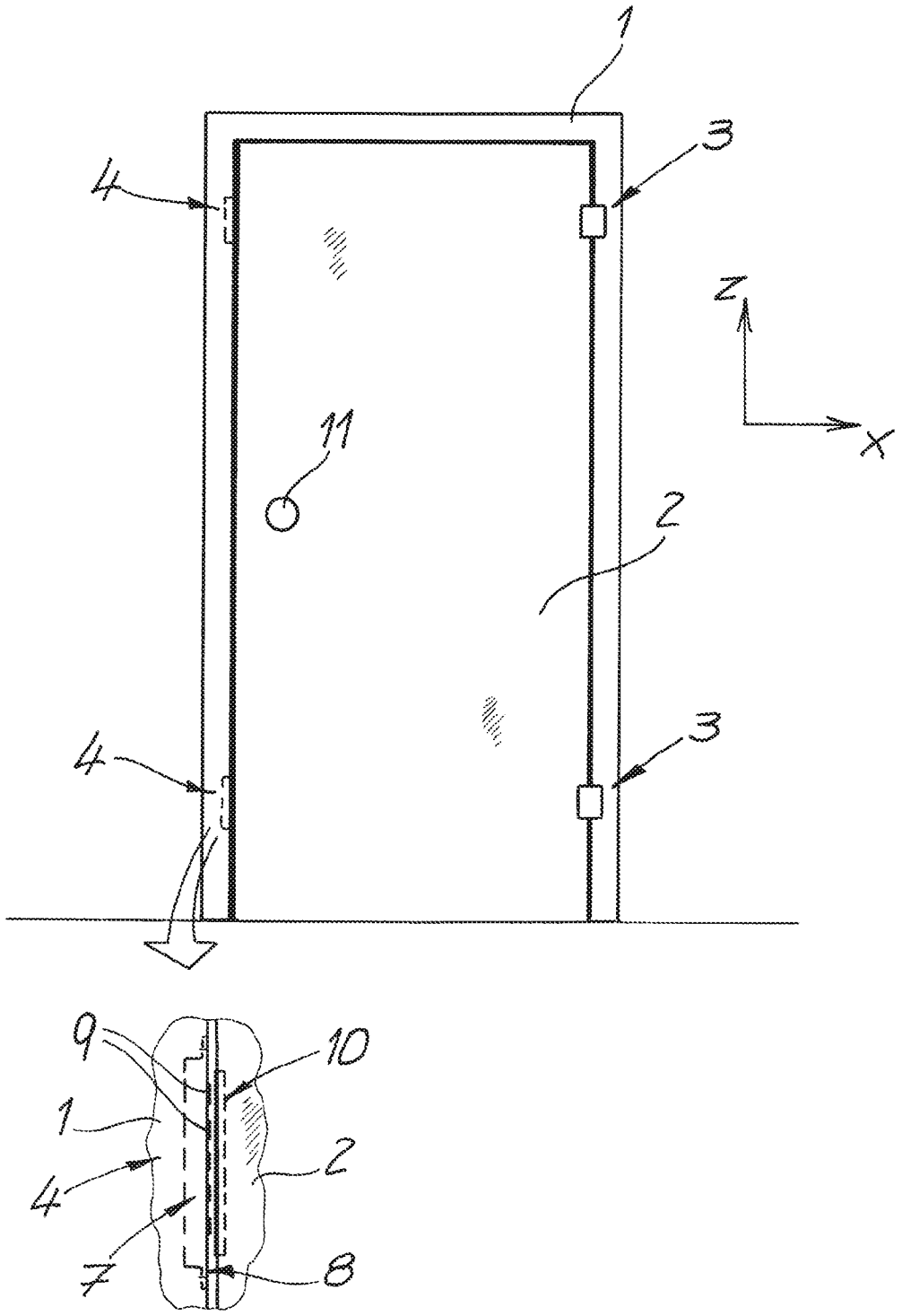
FIG. 1 shows a door arrangement with a closed door leaf and two magnetic closure devices on a side of the door leaf opposite the hinges.

FIG. 1 shows a door arrangement with a door frame 1, a door leaf 2, two door hinges 3 and two magnetic closure devices 4. In the illustrated closed condition, the door leaf 2 is positioned in a plane defined by a first horizontal direction X and the vertical Z.

Within the scope of the invention, the terms hinge side and side opposite the hinges refer to the rims of the door leaf 2, which are spaced apart from one another along the first horizontal direction X by the width of the door leaf 2. Accordingly, the door hinges 3 are located on the hinge side, while the two closure devices 4 are located on the side opposite the hinges. As will be explained in more detail below, the door leaf 2 is stopped in the closed position via a door seal (see below with reference to FIGS. 5*a* and 5*b*) against a step 6 of the door frame 1.

As will be explained in more detail below, magnet arrangements 7 of the magnetic closure device 4 at the side of the door leaf 4 are inserted in lateral arm 8 extending on the door frame 1 outside of the door leaf 2. The magnet arrangements 7 respectively have a plurality of magnets 9, wherein a portion 10 of magnetic material is disposed at the height of the magnet arrangement 7 on the door leaf 2. The portion 10 may be constructed as sheet-metal strips or sheet-metal angle pieces and may extend approximately over the same height as the magnet arrangement 7.

It is already evident in FIG. 1 that, for each magnetic closure device 4 between the magnet arrangement 7 and the portion of magnetic material 10, a clear gap remains along the first horizontal direction, and so the portion 10 of magnetic material is not stopped against the magnets 9. Accordingly, given the closing function according to the invention, both noise production and also a wear or an attrition are reliably avoided.

By virtue of the magnetic closure device 4, no lock with a lock case and a lock latch is necessary for the illustrated door arrangement in the form of a building interior door.

In opening direction, the door leaf 2 may be simply pushed or pulled open. For this purpose, a handle opening 11 in the door leaf 2 of glass is illustrated by way of example in FIG. 1, wherein alternatively a fixed handle in the form of a knob or bow may be disposed on at least one face or preferably on both faces of the door leaf 2. The portion 10 of magnetic material, which preferably is formed as sheet-metal strips or sheet-metal angle pieces, as well as a fixed handle may be adhesively bonded in particularly simple manner in a door leaf 2 of glass.

Figure 2:
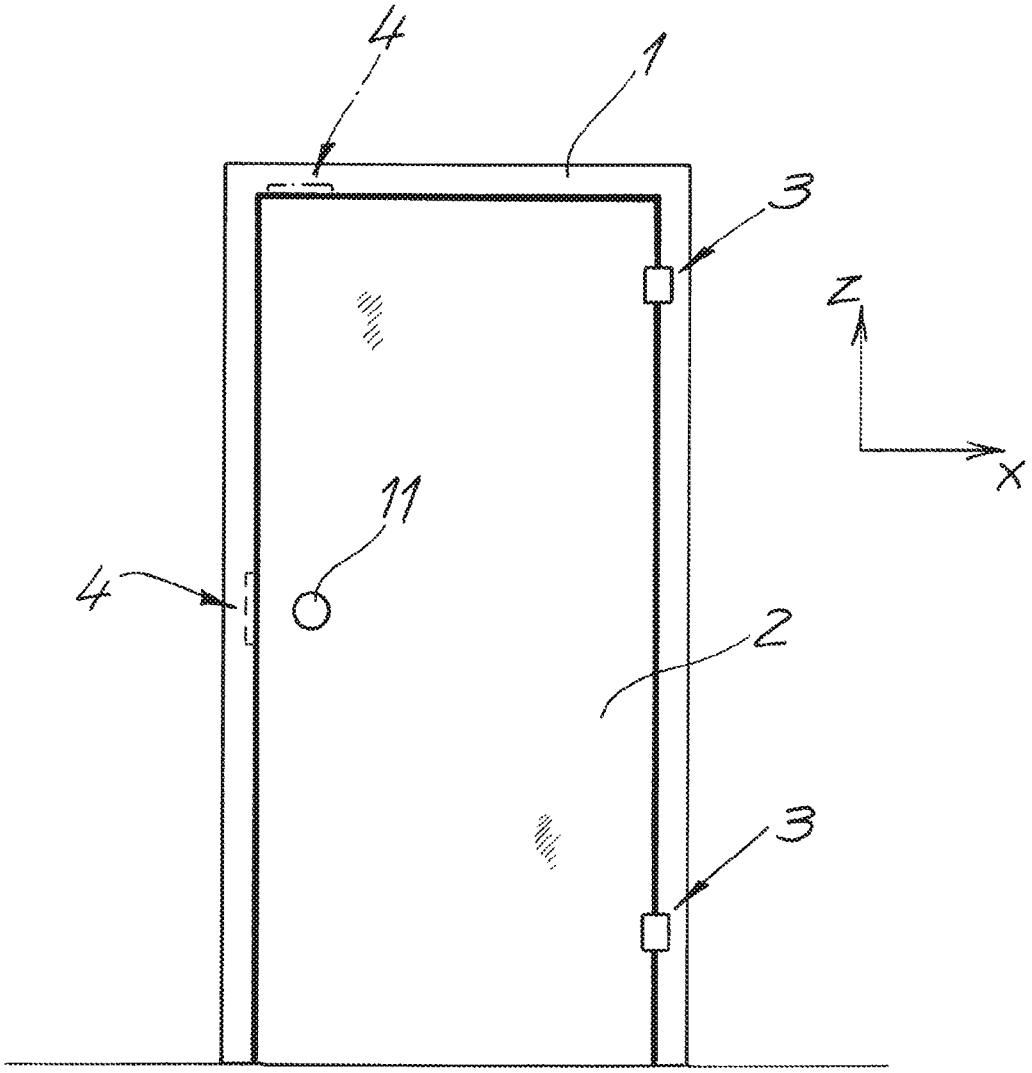
FIG. 2 shows the door arrangement according to FIG. 1 with merely one magnetic closure device at alternative positions.

FIG. 2 is intended to show that different configurations may be considered for the positioning of the closure device 4. In particular, the door arrangement may merely have one single magnetic closure device 4, which is disposed, for example, at height of the handle opening 11. Although an arrangement of the at least one magnetic closure device 4 on the side opposite the hinges is preferred, a different arrangement, for example in a lintel region above the door leaf 2, is also possible, wherein a corresponding arrangement is indicated as a dot-dash line in FIG. 2.

Figure 3:
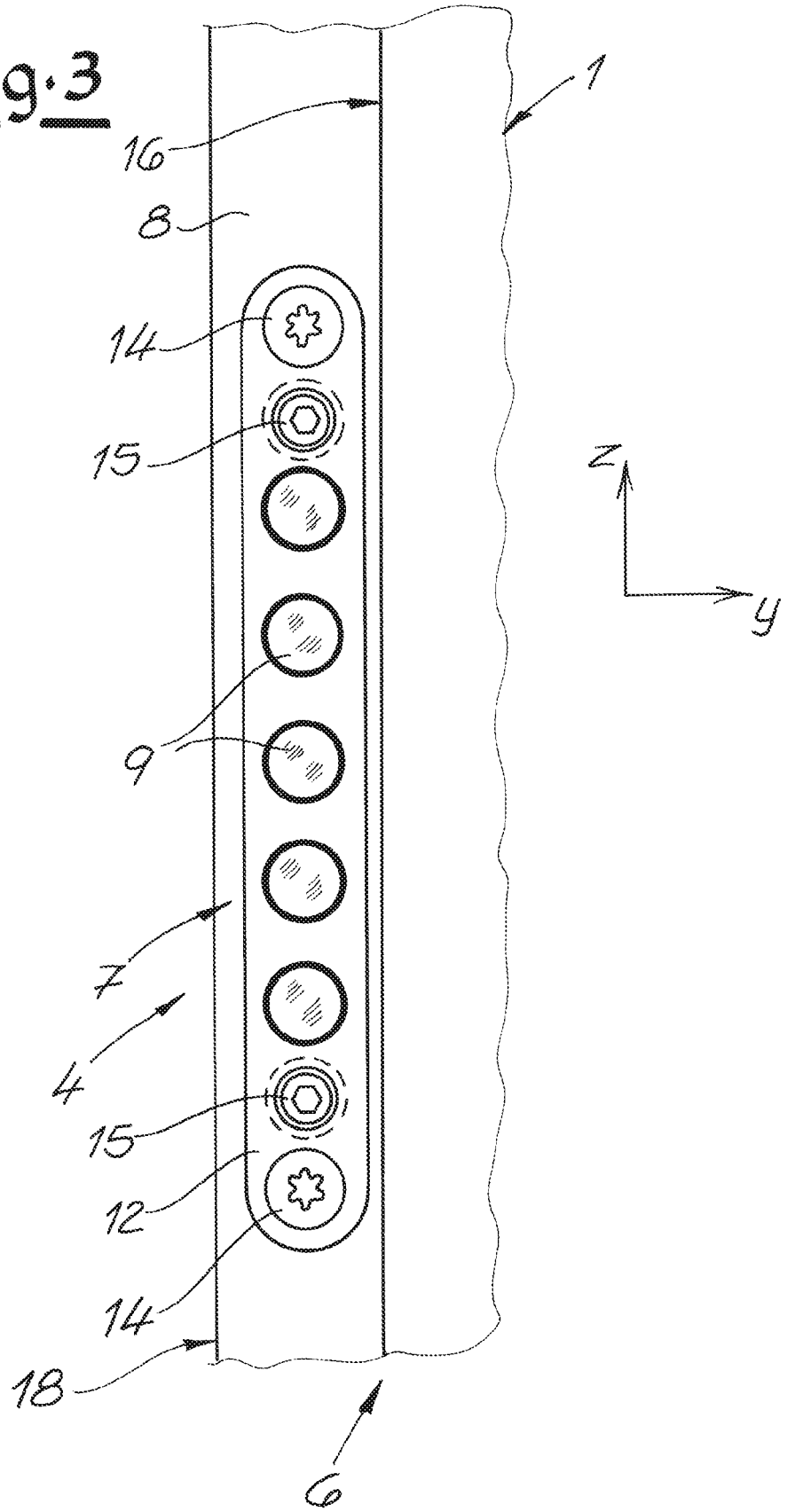
FIG. 3 shows a magnet arrangement of the magnetic closure device mounted on a door frame of the door arrangement.
Figure 4:
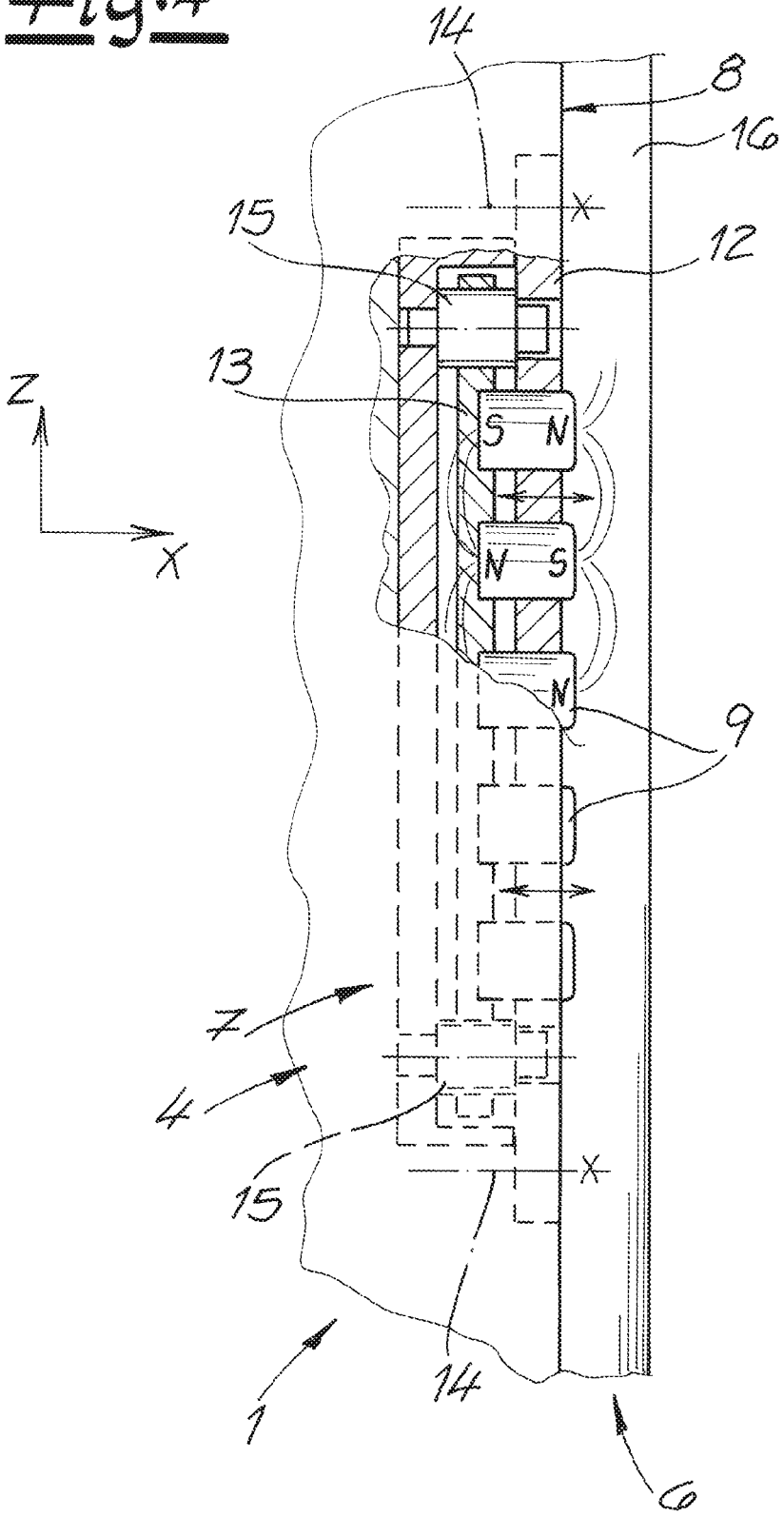
FIG. 4 shows the portion of the door arrangement illustrated in FIG. 3 in a partly cutaway view rotated by 90°.

Further details of the magnet arrangement 7 as a component of the magnetic closure device 4 are apparent from FIGS. 3 and 4. From a comparative examination of FIG. 3 as well as of FIG. 4, it is evident that the magnet arrangement has a fastening plate 12 fastened to the door frame 1, especially to the lateral arm 8, as well as a carrier plate 13, which can be positioned relative to the fastening plate 12 and which carries the magnets 9.

In the illustrated exemplary embodiment, five circular cylindrical magnets 9 are disposed, by way of example, one above the other in a row along the vertical direction Z, in which case commercially available standard constructions may be used.

The fastening plate 12 is fastened rigidly on the lateral arm 8 of the step 6 of the door frame 1 by screws 14, while the carrier plate 13 carrying the magnets 9 can be positioned by means of adjusting spindles 15 relative to the fastening plate 12, and thus the entire door arrangement can be positioned along the first horizontal direction X. By an actuation of the adjusting spindles 15, the magnets 9 are therefore moved along the first horizontal direction X, wherein, when a door leaf 2 is closed, the gap remaining relative to the portion 10 of magnetic material may be made larger and smaller. In this way, it is possible to adjust the closing forces of the magnetic closure device 4.

In FIGS. 3 and 4, it is also evident that the fastening plate 12 has openings, through which the magnets 9 are guided.

The specific structural shape of the magnet arrangement 7 as well as the configuration of the positioning is purely exemplary.

According to FIG. 4, the magnets 9 disposed one above the other have an alternating polarity. The magnets 9 are aligned along the first horizontal direction X and, when a door leaf 2 is closed, point in the direction of the portion 10 of magnetic material, which is then adjacent.

In order to permit an easy movement of the magnets 9 and to prevent an impairment of the closing forces, the fastening plate 12 is expediently made from a nonmagnetic metal. In contrast, the carrier plate 13 is preferably made from a magnetic material, especially a ferromagnetic material, in order to form a kind of magnetic yoke element. Thereby the closing forces may also be enhanced, and undesired magnetic stray fields are also reduced.

Individual magnetic-field lines are illustrated by way of example in FIG. 4, wherein the door leaf 2 is open and thus the field lines are able to emerge on the front side of the magnet arrangement 7. Due to the alternating polarities of the magnets 9, however, a large zone of influence of the magnetic forces, which may be disadvantageous for a user, is prevented.

Figure 5A:
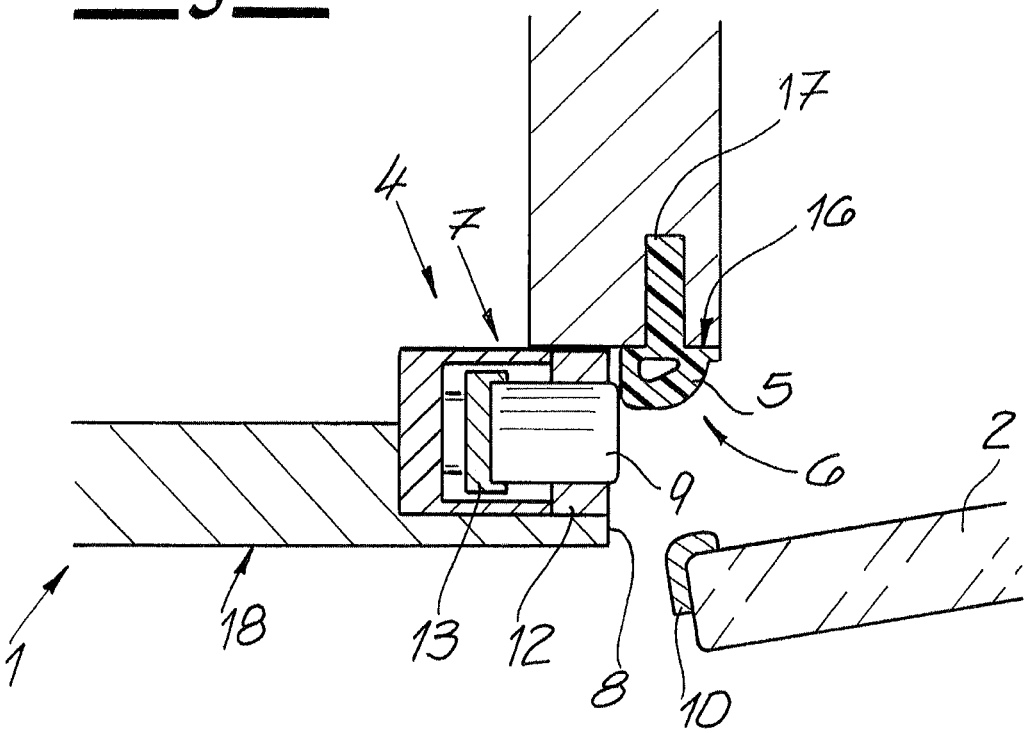
FIG. 5*a* shows a horizontal section through the door arrangement in the opened condition.
Figure 5B:
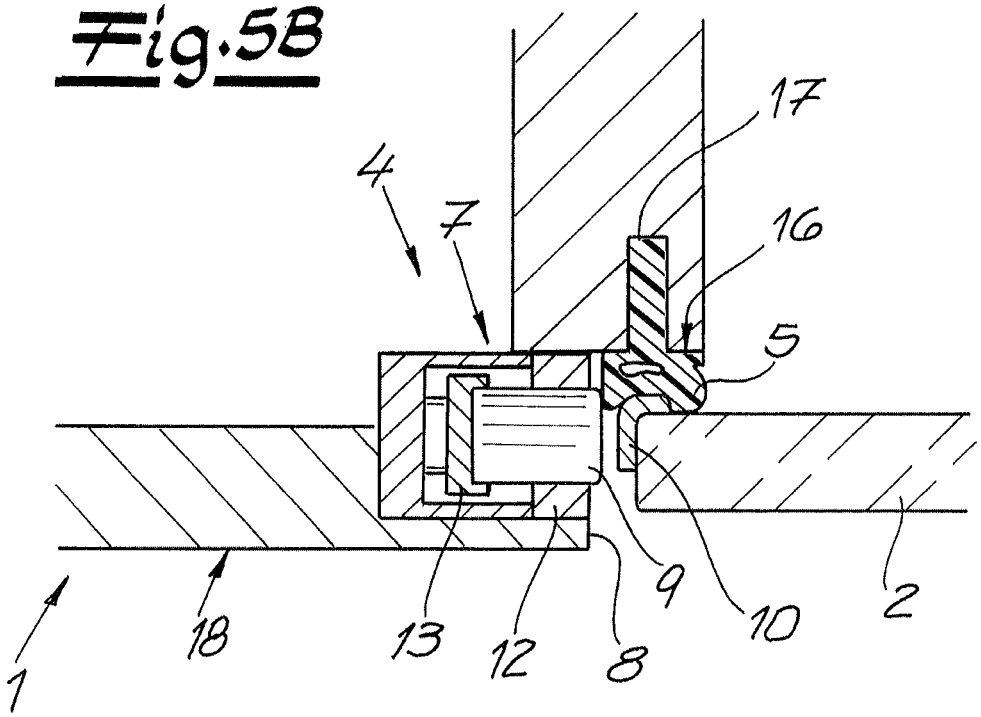
FIG. 5*b* shows a horizontal section through the door arrangement with a closed door leaf.

The arrangement of the at least one magnetic closure device 4 on the door arrangement is illustrated particularly clearly in FIGS. 5*a* and 5*b*. Accordingly, the door frame 1 has the step 6 described in the foregoing, in order to form a stop for the door leaf 2. This step comprises a stop angle-piece 16, against which the rim of the door leaf 2 bears via the door seal 5. For this purpose, the door seal 5 is held in a seal groove 17 machined in the stop angle piece 16.

In FIG. 5*b*, which shows the door leaf 2 in its closed position, the clear gap is evident between the magnets 9 of the magnet arrangement 7 on the one hand and the portion 10, configured as a sheet-metal angle piece, of magnetic material.

Since the magnet arrangement 7 is inserted in the lateral arm 8, it is hardly perceptible for the user, especially when the door leaf 2 is closed. The same is also true for the portion 10 of magnetic material, which in the closed position of the door leaf 2 is also covered at least partly by the door seal 5.

According to the horizontal section of FIGS. 5*a* and 5*b* along the first horizontal direction X as well as the second horizontal direction Y, the stop angle piece 16 as well as the lateral arm 8 on the step are disposed at right angles to one another. The inconspicuous integration of the magnet arrangement 7 in the lateral arm 8 is also supported by the fact that, in the illustrated exemplary embodiment, the magnet arrangement 7 is partly concealed by the door seal 5 when the door leaf 2 is open.

It is also evident from FIGS. 5*a* and 5*b* that the door leaf 2 can be disposed, in simple manner, flush with a front side 18 of the door frame 1, by an appropriate modification of the geometry.

What is claimed is:

1. A door arrangement comprising:

a door frame;

a door leaf made of glass;

door hinges fastened on a hinge side of the door leaf and swivelably joining the door leaf with the door frame; and a magnetic closure device consisting of a magnet arrangement and a sheet of magnetic material, the magnet arrangement comprising at least one magnet, wherein the magnet arrangement has a fastening plate fastened to the door frame and a carrier plate configured to be positioned relative to the fastening plate and which carries the at least one magnet, the at least one magnet extending through at least one opening in the fastening plate, wherein the magnet arrangement has a positioning mechanism comprising spindles that are connected to the carrier plate and are accessible through the fastening plate to move the carrier plate relative to the fastening plate by adjusting the spindles, so that a gap between the at least one magnet of the magnet arrangement and the sheet of magnetic material when the door leaf is in a closed position is adjustable, wherein the sheet of magnetic material mounted directly to the glass on a rim of the door leaf, for retaining the door leaf in the closed position;

wherein the door frame has a step for stopping the door leaf in the closed position, the step comprising a stop arm overlapping the door leaf in the closed position and a lateral arm, and wherein the magnet arrangement is disposed on the lateral arm such that the gap remains between the at least one magnet of the magnet arrangement and the sheet of magnetic material disposed on the rim of the door leaf when the door leaf is in the closed position.

2. The door arrangement according to claim 1, wherein the door leaf has a handle opening or a fixed handle.

3. The door arrangement according to claim 1, wherein only one said magnetic closure device is provided and which is disposed at a middle of a height of the door leaf.

4. The door arrangement according to claim 1, wherein the at least one magnet comprises a plurality of magnets disposed in a row.

5. The door arrangement according to claim 4, wherein the magnets are arranged so that each of the magnets has a pole alignment that is opposite an adjacent one of the magnets.

6. The door arrangement according to claim 4, wherein the magnets each have a cylindrical shape.

7. The door arrangement according to claim 1, wherein the at least one magnet has a cylindrical shape.

8. The door arrangement according to claim 1, wherein the fastening plate is made of a nonmagnetic material.

9. The door arrangement according to claim 1, wherein the carrier plate is made from a magnetic material.

10. The door arrangement according to claim 1, wherein a door seal is disposed on the stop arm.

11. The door arrangement according to claim 10, wherein the door seal is held in a seal groove machined in the stop arm.

12. The door arrangement according to claim 10, wherein the door seal at least partially conceals the magnet arrangement when the door leaf is open.

* * * * *